United States Patent [19]

Guiraud

[11] 4,187,705

[45] Feb. 12, 1980

[54] IMPROVEMENTS IN OR RELATING TO BRAMAH LOCKS

[75] Inventor: Francois Guiraud, Chambourcy, France

[73] Assignee: Fichet-Bauche French Body Corporation, Velizy, France

[21] Appl. No.: 888,198

[22] Filed: Mar. 20, 1978

[30] Foreign Application Priority Data

Mar. 24, 1977 [FR] France ..... 77 08877

[51] Int. Cl.[2] ..... E05B 29/00

[52] U.S. Cl. ..... 70/362; 70/363; 70/365

[58] Field of Search ..... 70/357, 362, 363, 365, 70/366, 419

[56] References Cited

U.S. PATENT DOCUMENTS 2,023,847 12/1935 Liss ..... 70/365

3,035,433 5/1962 Testa ..... 70/419

*Primary Examiner*—Robert L. Wolfe

[57] ABSTRACT

There is disclosed a Bramah lock suitable for use on a safe-deposit box or an armored door in which the bolt of the locking mechanism is actuatable by bars which are disposed in serially arranged sets extending through the door to a keyhole and co-operable by abutment so that displacements of the bars relatively adjacent to the keyhole are not transmitted to bars relatively remote therefrom. An externally toothed gear coaxially of the barrel is operatively disposed between the barrel and the bolt for controlling the operation of the latter. There are a plurality of toothed sector members with slots in engagement with a fence plate when they are in alignment, the fence plate being driven by a check fence plate resiliently connected thereto and displaceable in response to the barrel motion so as to permit rotation of the barrel even if the fence member is not in engagement with the slots in the sector members.

21 Claims, 22 Drawing Figures

IMPROVEMENTS IN OR RELATING TO BRAMAH LOCKS

The present invention relates to Bramah locks.

Bramah locks have been used for a long time, namely for locking safe deposit boxes and vault or armored doors.

Advantage is thus taken, inherent in this type of lock, of a mechanism protected by the thickness of the door or other reinforced panel in which it is housed, although the lock can be actuated by a key of small length.

In a Bramah lock, the locking and unlocking mechanism, positioned on the inner face of the panel or door receiving the lock, is controlled by bars or motion transmitting members disposed in a barrel extending through the wall and opening on the outer face of the panel or wall to define the keyhole.

The Bramah lock according to the invention affords greater security than known Bramah locks. It efficaciously foils attempts to reach the locking mechanism step-by-step by introduction of with mechanical tools in the barrel where the tumblers are housed.

The present Bramah lock also thwarts unauthorized attempts to unlock the lock by successive maneuvers on the motion transmitting members, or attempts at picking the lock.

It is designed not to be affected by unauthorized attempts to force it and is thus of the "disconnectable" type although it insures a positive retaining of the bolt until the right key is inserted.

It is, in addition, adapted to control the opening of a plurality of bolts.

The manufacture of the present Bramah lock is simple and its production cost low.

According to the invention there is provided a Bramah lock for a door or a safe-deposit box or an armored door comprising a locking and unlocking mechanism having at least a bolt actuatable by motion transmitting members extending through the door to a keyhole, said motion transmitting members being arranged in series and cooperable by abutment from the keyhole to the locking and unlocking mechanism so that displacements towards the keyhole of said motion transmitting members relatively adjacent to the keyhole are not transmitted to said motion transmitting members relatively remote therefrom.

According to another aspect of the invention there is provided a Bramah lock having a locking and unlocking mechanism including a bolt operative in response to displacements of a barrel, comprising an externally toothed gear coaxially of said barred and operatively disposed between said barrel and said bolt for controlling the operation of said bolt.

According to yet another aspect of the invention, there is also provided a plurality of coaxial toothed sectors members, each of them driven by said motion transmitting members, the edge of each sector member being provided with a slot for the engagement of a fence when the slots are aligned, wherein the fence is displaceable by a counter-fence, spring means being operatively disposed between said fence and said counter-fence, the latter being drivable through the barrel in order to allow a rotation of the barrel even when the fence is not in engagement with the slots.

Preferably, the sector members are driven respectively by the motion transmitting members or bars which are pushed at their ends by slots in the key, several bars being mounted one behind another and in abutting relation for motion transmission whereby an unauthorized manipulation comprising pulling one of the outer bars is ineffective for operating the locking and unlocking mechanism.

There is also provided a guiding of the bars by diametrically oriented cross pieces arranged in the barrel.

The ends of some of the cross pieces are received in grooves in the fixed lock case thereby forming a barrier against attempts to penetrate a tool towards the lock mechanism and also prevents pushing back the barrel.

Other features follow from the description, given by way of example with reference to the accompanying drawings, in which.

Figure 1:
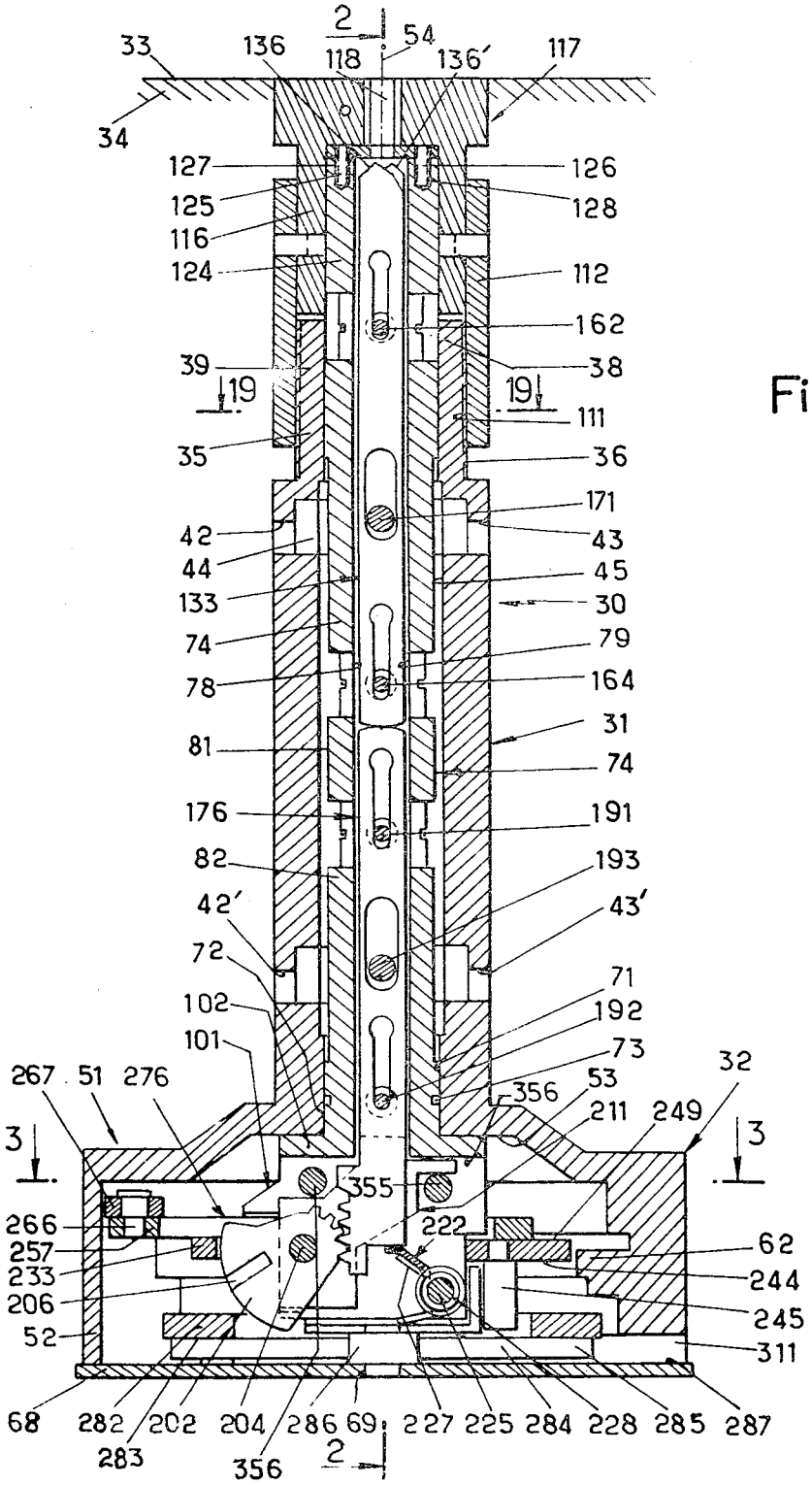
FIG. 1 is a longitudinal sectional view of a lock embodying the present invention.

The lock (FIG. 1) comprises a lock case 30 including a tube 31 flaring into a cup-shaped member 32. The end of the tube 31 facing forwards, that is, towards the outer surface 33 of the panel or door 34 through which the tube 31 extends, has a neck 35 with external threads 36, the front edge 37 of which being provided with two diametrically opposed teeth 38 and 39. The tube 31 possesses two diametrically opposed holes 42 and 43 leading to a groove 44 formed in the inner surface 45 of the tube 31, which groove is defined by a forward annular shoulder 46 (FIG. 2) and a rear annular shoulder 47. The holes 42 and 43 have a diameter less than the distance between the shoulders 46 and 47 so that there is gap between the forward tangential plane of the hole and the shoulder 46. A similar arrangement is provided towards the rear end of the tube 31, references of the parts of that arrangement being the same as those which have just been described except that each reference is primed.

Figure 3:
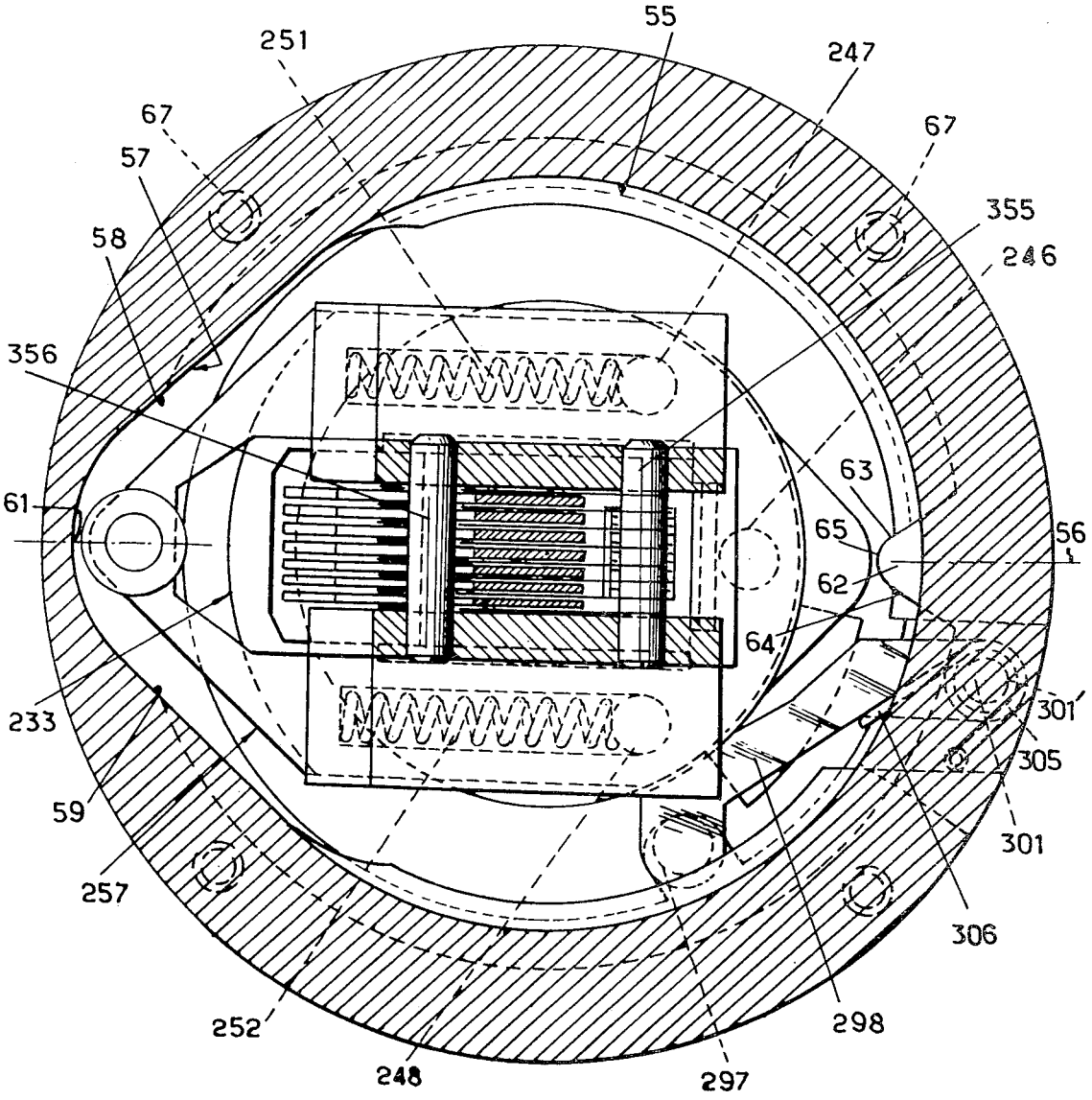
FIG. 3 is an enlarged transverse cross-sectional view taken on line 3—3 in FIG. 1.

The cup-shaped member 32 has an annular end wall 51 and a cylindrical sidewall 52 and its interior surface forms at the connecting zone with the interior surface 45 of the tube 31 an annular shoulder 53 perpendicular to the axis 54 common to the tube and the cup-shaped member 32. The interior surface of the sidewall 52 of the cup-shaped member 32 has a cylindrical portion 55 (FIG. 3) with an axis 54 and, arranged symmetrically with respect to a diametral plane 56, a camway 57 with two inclined zones 58 and 59 gradually approaching the axis 54 from a generatrix 61 in the plane 56.

The interior surface 55 of the cylindrical sidewall of the cup-shaped member 32 has diametrically opposite the generatrix 61 a relief portion 62, substantially midway along the cylindrical sidewall 52, defined by two flanks 63 and 64 respectively to each side of a rounded apex 65 located in the plane 56. Tapped holes 67 are cut in the sidewall 52 of the cup-shaped member for bolting thereon a cover 68 having a central aperture 69.

Figure 19:
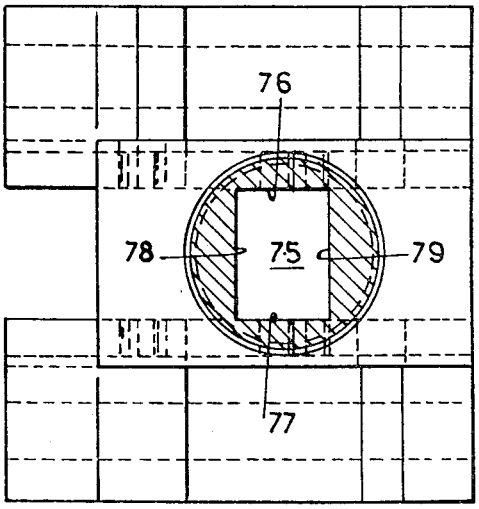
FIG. 19 is a cross-sectional view of a barrel taken on line 19—19 in FIG. 1.

Rotatably mounted inside the tube 31 by means of bearings 71 and 72 to each side of a groove 73 provided for accomodating a ring member, is a barrel 74 defining a channel 75 of rectangular transverse cross-section (FIG. 19) formed by four faces 76, 77, 78 and 79. The outer surface 81 of the barrel 74 is, overall, of cylindrical configuration. The wall 82 of the barrel is perforated with holes arranged in opposed pairs 83 and 84, 85 and 86, 87 and 88,89 and 90, 91 and 92, 93 and 94, the last of which are level with the bearings 71 and 72. The axes of holes of each pair are disposed in a transverse plane.

The barrel-shaped body 101 which extends the cylindrical part of the barrel possesses a first parallelepipedic block 102 followed by a second such parallelepipedic block 103 whose longitudinal direction is perpendicular to that of the block 102. The block 103 is continued by two lugs 104 and 105 limited by parallel planar external faces 350 and 352 and opposite inner faces which are connected to each other by a planar face 356 perpendicular to the lugs 104 and 105, into which the channel 75 leads. The lower face 106 of the block 103 has two grooves 107 and 108 of rectangular cross-section and is connected to faces 350 and 352 by shoulders 351, 353.

By its external threads 36 the neck 35 is adapted to co-operate with a tapped hole 111 in a sleeve 112 assemblable by pins with the cylindrical body 116 of a nose piece 117 (FIG. 18) made of hardened steel and having a keyhole 118.

Figure 18:
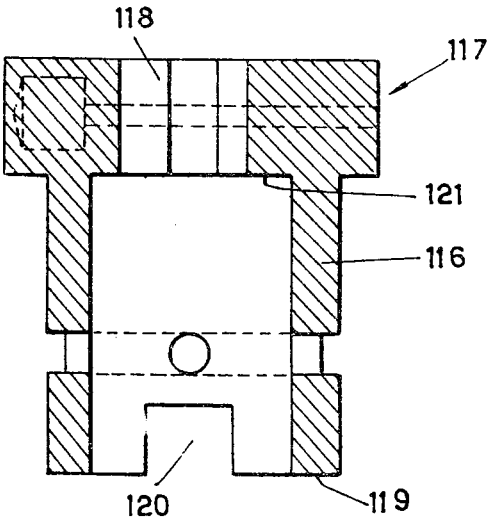
FIG. 18 is a cross-sectional view of a nose piece.
Figure 20:
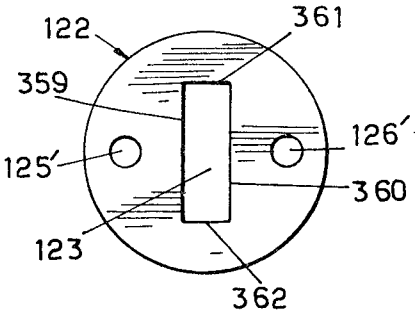
FIG. 20 is a top view of a disc.
Figure 22:
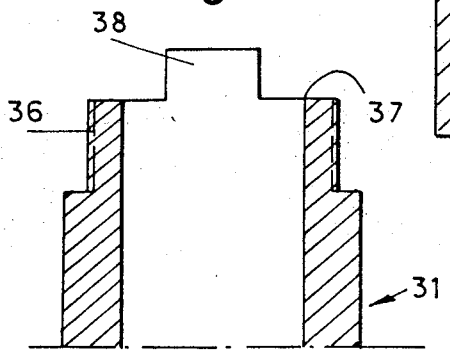
FIG. 22 is a fragmentary longitudinal cross-sectional view of the forward part of the lock.

The rear edge 119 of the body 116 has two cutouts 120, 120', of which only cutout 120 may be viewed in FIG. 18, which are diametrically opposed and adapted to co-operate with teeth 38 and 39 on the tube 31. The assembly comprising the case 30 and the nose piece 117 is of adjustable length such that there is no play between the rear face 121 of the nose piece 117 into which protrudes the keyhole 118 and a disc 122 (FIG. 20), with a keyhole 123 extending keyhole 118, fixed on the forward section 124 of the barrel by pins 125 and 126 in engagement with openings 125' and 126' formed in the disc 122 and cooperating with smooth bores 127 and 128 in the section 124. The keyhole 123 is defined by two straight sides 359, 360 parallel to faces 78 and 79, respectively, in the channel 75 in the barrel 74 and two transverse sides 361 and 362.

Figure 4:
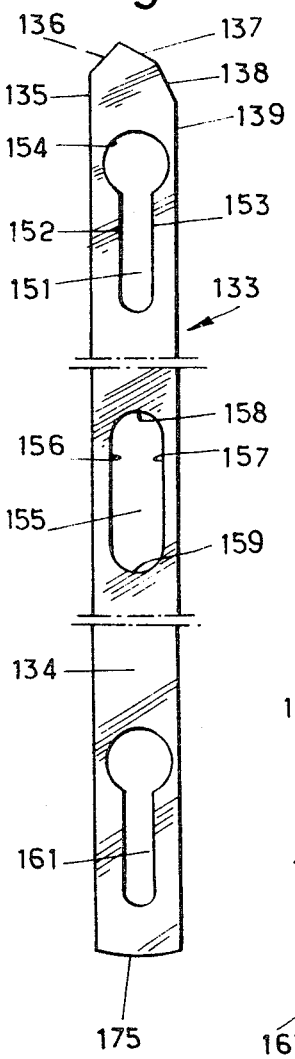
FIG. 4 is a front view of a bar adjacent the keyhole.
Figure 5:
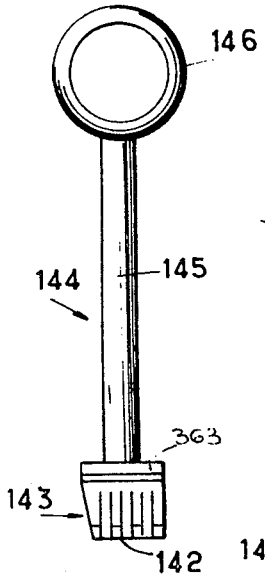
FIG. 5 is a front elevational view of a key for the lock.
Figure 6:
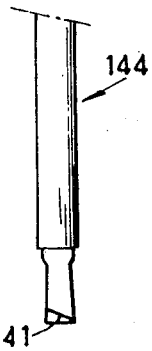
FIG. 6 is a fragmentary side view of the key viewed in FIG. 5.
Figure 7:
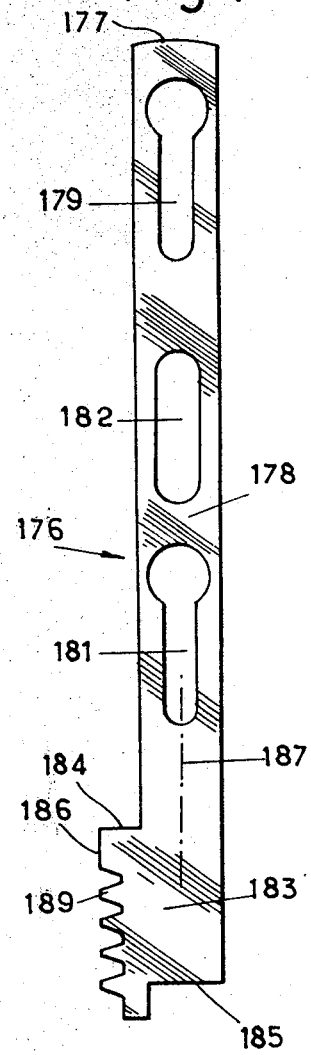
FIG. 7 is a front elevational view of a bar adjacent to the mechanism.

In the channel 75 of rectangular cross-section of the barrel 34 are accommodated flat motion-transmitting members or bars which comprise a first forward set 131 followed by a second set 132. Each bar 133 of the forward set 131 has a flat body 134 (see FIG. 4) of rectangular cross-section and at its forward end starting from a longitudinal side 135 a first angulated side 136 followed by a second angulated side 137 of opposite slope followed by a third angulated side 138 of greater slope than that of side 137, which is joined to the other, opposite longitudinal side 139. The angulated side 137 of the bar is operated by a cut 141 (FIG. 6) in the end 142 of the bit 143 of a key 144 (FIG. 5) having a stem 145 and a ring 146. The bit 143 is connected to the stem 145 by a parallelepipedic body 363 adapted to be received in the keyhole 123 and drive the disc 122 in rotational movement. The diameter of the stem 145 is greater than the side 361 of keyhole 123.

All the bars 134 of the first set 131 are identical but are arranged so that the longitudinal sides 135 and 139 are alternately towards the face 78 and the face 79 of the channel 75 as is clearly viewed in FIG. 1 where the side 136 of a bar 133 is seen entirely to the left of axis 54 and the longitudinal side 136' of the adjacent bar is entirely to the right of axis 54.

Each bar 133 has a first slot 151 defined by two straight parallel sides 152 and 153 connected to each other by a near circular aperture 154 of diameter greater than the distance between the opposed sides 152 and 153. A second slot 155 is defined by straight sides 156 and 157 which are connected by semi-circular zones 158 and 159.

A third slot 161 has the same configuration as the first slot 151.

Figure 8:
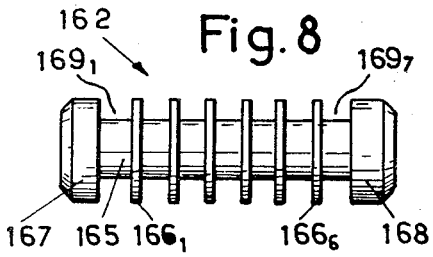
FIG. 8 is an elevational view of a cross piece.

Slots 151 and 161 serve to guide a bar 133 by cross-pieces 162 and 164. Each cross-piece 162 (see FIG. 8) has a cylindrical body 165 from which protrude ribs $166_1$–$166_6$ defining between one another and between them and the heads 167 and 168 annular notches $169_1$–$169_7$ for seven bars $133_1$–$133_7$, in case of a key with seven cuts. The diameter of the body 165 corresponds to the distance between two parallel sides 152 and 153. The heads 167 and 168 are received in the opposed pairs of holes, e.g. 83 and 84.

The slot 155 act as passageways for a hardened steel bar 171 which protrudes at its ends 172 and 173 with respect to the outer surfaces 81 of the barrel 74 through opposed pairs of holes, such as 85 and 86, ends 171 and 173 being accommodated in groove 44.

The end 134 of a bar 133 opposite to that of the angulated sides 136–138 has a rounded portion 175. The bar 133 of the first set 131 are in abutting contact with the bar 176 of the second set through the rounded portion 175. The bar 176 have rounded portions 177 co-operating with the sides 175 of the bar 133 and their body 178 is cutout such that to have slots 179 and 181 similar to slots 151 and 161 in bar 133 and a slot 182 similar to slot 155.

At their end opposed to end 177, the bars 176 which are identical to each other each have an enlarged portion 183 forming a forward shoulder 184 and a rear shoulder 185, the side 186 parallel to the mean center line 187 of the bar having straight racklike teeth 189.

Bars 176 are guided for lengthwise movement by cross-pieces 191 and 192 similar to cross-pieces 162 and 164. A bar 193 is received in slots 182 in juxtaposed cross-pieces 176. The enlarged portions 183 of the bars 176 are housed in the space formed between lugs 104 and 105.

Figure 9:
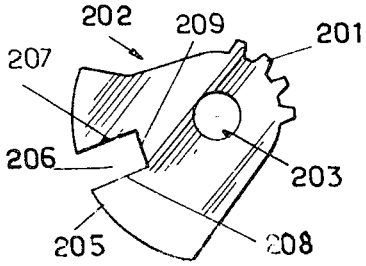
FIG. 9 is a front elevational view of a sector member.

Each of the racklike teeth 189 co-operate with a part circular toothed sector 201 (FIG. 9) provided on a sector member 202 having a hole 203 for a spindle 204 fixed with the barrel 74. The part circular edge 205 of the sector member 202 has a notch 206 with parallel edges 207 and 208 connected by an inner edge 209.

Figure 10:
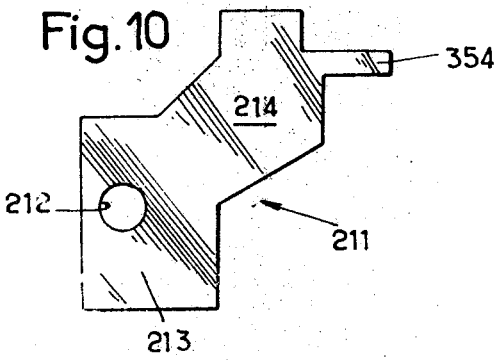
FIG. 10 is a front elevational view of a leaf spring.
Figure 12:
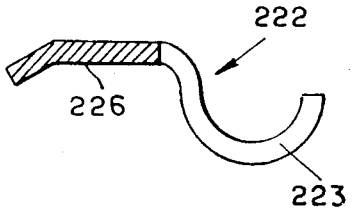
FIG. 12 is a cross-sectional view taken on line 12—12 in FIG. 11.
Figure 14:
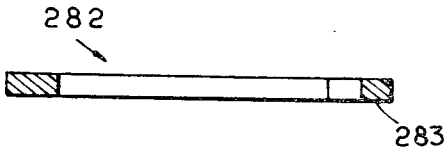
FIG. 14 is a cross-sectional view taken on line 14—14 in FIG. 13.

There are as many sector members 202 as there are bars 176 and the movements of the sector members 202 are made independent of one another owing to resilient leaf springs 211 interposed between adjacent sector members 202, which springs are mounted through their holes 212 which they have along the spindle 204 (FIG. 10). The hole 212 is made in a portion 213 of the leaf spring 211 which is slightly bent with respect to the portion 214 interposed between a pair of consecutive bars. Upon assembly a sector member 202 is held with a slight pressure by portions 213 and 213' of consecutive leaf springs 211 and 211', the portions 214 and 214' of which are held by consecutive bars which are in turn held by the ribs on the cross-pieces 191 and 192. Each resilient leaf springs 211 has a tab 354 connected to its portion 214 for maintaining in position the leaf spring by engagement between the face 356 and a bar 355 which bears at its ends against lugs 104 and 105. Thus the sector members 202 are held against movement except through bars 176 although requiring only a small force to be exerted by the bars and also providing for independent movements of the sector members.

Figure 11:
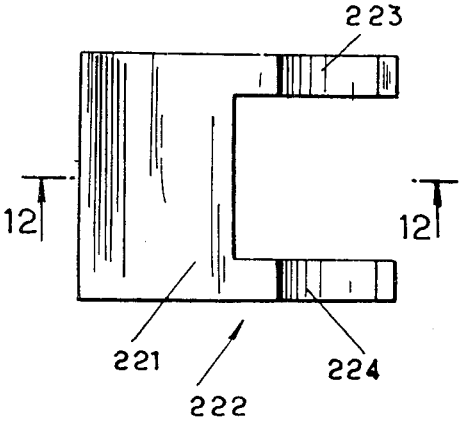
FIG. 11 is a bottom view of a pivoted member.

The body 221 of a pivoted member 222 (FIG. 11) co-operates with the shoulders 185 on bars 176 which pivoted member is pivotally mounted by its limbs 223 and 224 about a pivot 225. The body 221 is subjected at its rear face 226 to the force of the arm 227 of a torsion spring 228 coiled around the stem 225.

Figure 15:
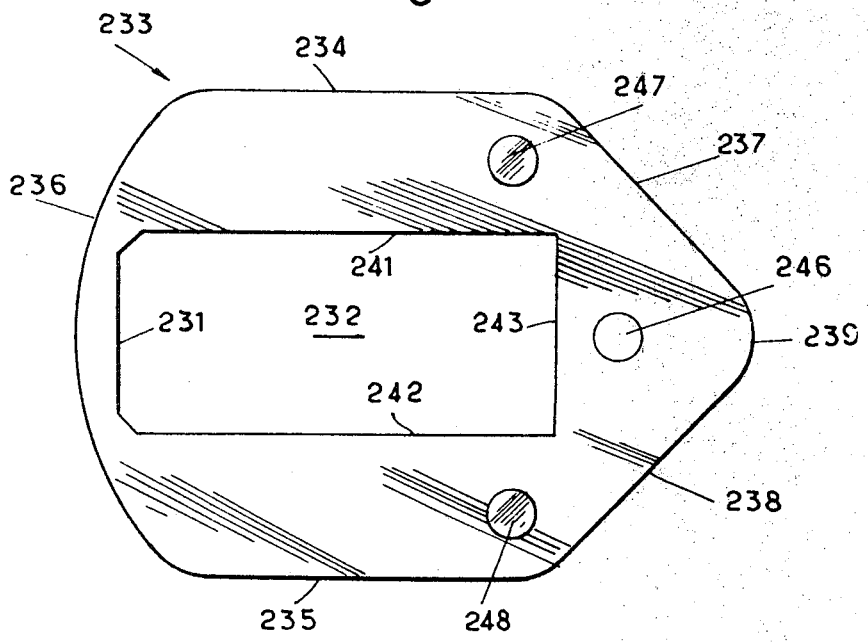
FIG. 15 is a front elevational view of a fence plate or member.
Figure 16:
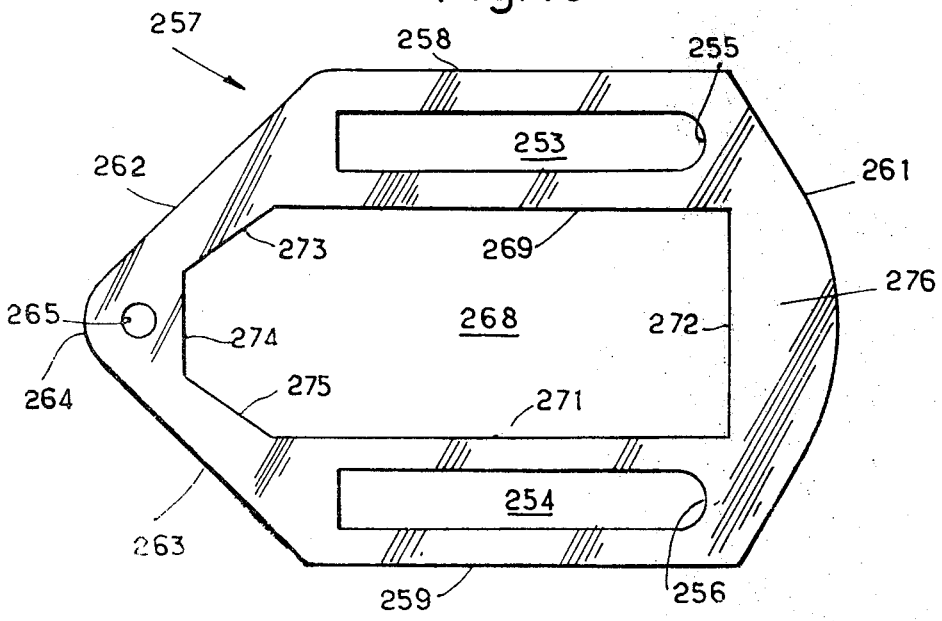
FIG. 16 is a front elevational view of a counter fence plate or member.

The edges 205 of the sector members 202 are adapted to co-operate with the edge 231 (FIG. 15) of a window 232 in a fence or member 233 of generally oblong configuration defined by parallel longitudinal sides 234 and 235 connected at one end by a circular edge 236 and at the other end by two substantially straight edges 237 and 238 forming a V with a rounded apex 239. In addition to the edge 231 the window 232 is defined by two longitudinal edges 241 and 242 and edge 243 opposite edge 231. From the rear face 244 of the fence plate 233 projects a pin 245 inserted in a hole 246 in the fence plate. Two protrusions 247 and 248 protrude from the opposite face 249 of the fence plate. The protrusions 247 and 248 are urged by coil springs 251 and 252 received in substantially rectangular slots 253 and 254 of which one edge respectively 255 and 256, however, is semi-circular. The slots 253 and 254 are formed in a counter-fence or check fence plate 257 (see FIG. 16) flush against face 249 of the fence plate 233 which likewise is of generally oblong configuration. The check fence plate 257 is defined by two longitudinal edges 258 and 259 connected to each other at one end by a part-circular edge 261 overlying the rounded apex 239 of the fence plate 233 and by two straight edges 262 and 263, forming an apex 264 having a hole 265 for engagement with a pintel 266 of a roller 267. The check fence plate 257 also has a window 268 with longitudinal sides 269 and 271 connected at their ends adjacents edge 261 by a perpendicular edge 272 and at the opposite ends by streight edges 273, 274 and 275 of which edges 273 and 275 are inclined relative to edges 272 and 274.

The coil springs 251 and 252 are of a sufficiently large diameter to protrude relative to the forward face 276 of the check fence plate and to be received in grooves 107 and 108 in the block 103 of the barrel 74, the fence plate and the check fence plate being slidably mounted by their windows 232 and 268 along the lugs 104 and 105 on the barrel 74.

Figure 13:
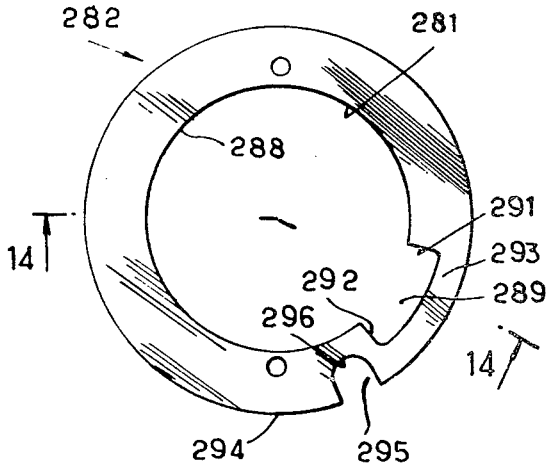
FIG. 13 is a front elevational view of a ring member.

The pin 245 on the fence plate 233 is of sufficient length to enter the opening 281 of a ring member 282 (see FIG. 13) fixed by its rear face 283 to a pinion or gear 284 with external teeth 285; the ring member 282 is mounted for rotation about a collar 286 projecting outwardly from the inner or forward face 287 of the cover 68.

Figure 17:
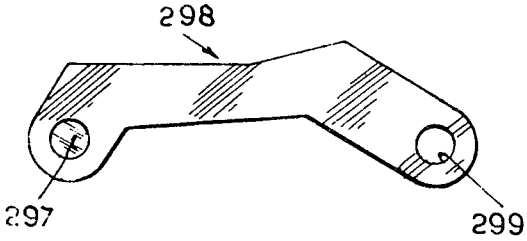
FIG. 17 is a front elevational view of a lever.

Opening 281 comprises over its greater part a circular arc 288 but also has a wide notch 289 the diameter of which is greater then the diameter of the arc 288, with flanks 291 and 292, the width of the portion 293 of the ring member along the notch 289 thereby being smaller than over the remainder of the ring member. The outer edge 294 of the ring member has a notch 295 with a semi-circular inner edge 296. With the edge 294 a peg 297 cooperates located at one end of lever 298 (see FIG. 17) on which is mounted through its hole 299 at its other end about pivot pin 301 (FIG. 3) rotatably mounted in a recess 301' formed in the cup-shaped member 32. A torsion spring 305 is also disposed around the pivot pin 301, the leg 306 of the spring 305 urging the lever member 298 so that its peg 297 co-operates with the outer edge 294 of the ring member 282.

The teeth 285 mesh with one or more pinions or gears (not shown) which project from the cup-shaped member 32 through openings 311 provided therein. The pinion(s) or gear(s) thus driven by teeth 285 is (are) adapted to control the withdrawal and extension of one or more bolts.

A stirrup-shaped member 316 having legs 317 and 318 is fixed to the lugs 104 and 105 of the barrel by screws 319 and 321, the forward edges of the legs 317 and 318 thereby serving as a support for the fence plate 233, the check fence plate 257 bearing itself on the rear face 106 of the parallelepipedic or prismlike block 103. The longitudinal edges 241 and 242 of the window 232 in the fence plate are then slidably mounted on the faces 350 and 352 of the lugs 104 and 105 while the longitudinal edges 269 and 271 of the window 268 in the check fence plate are in contact with faces 351, 353.

A hardened steel bar 356 similar to bar 355 is mounted between the lugs above the spindle 204 in the spaced provided between the upper portions of the leaf springs 211 and face 356 so as to impede unauthorized piercing against the spindle 204.

The operation of the lock just described follows.

Figure 2:
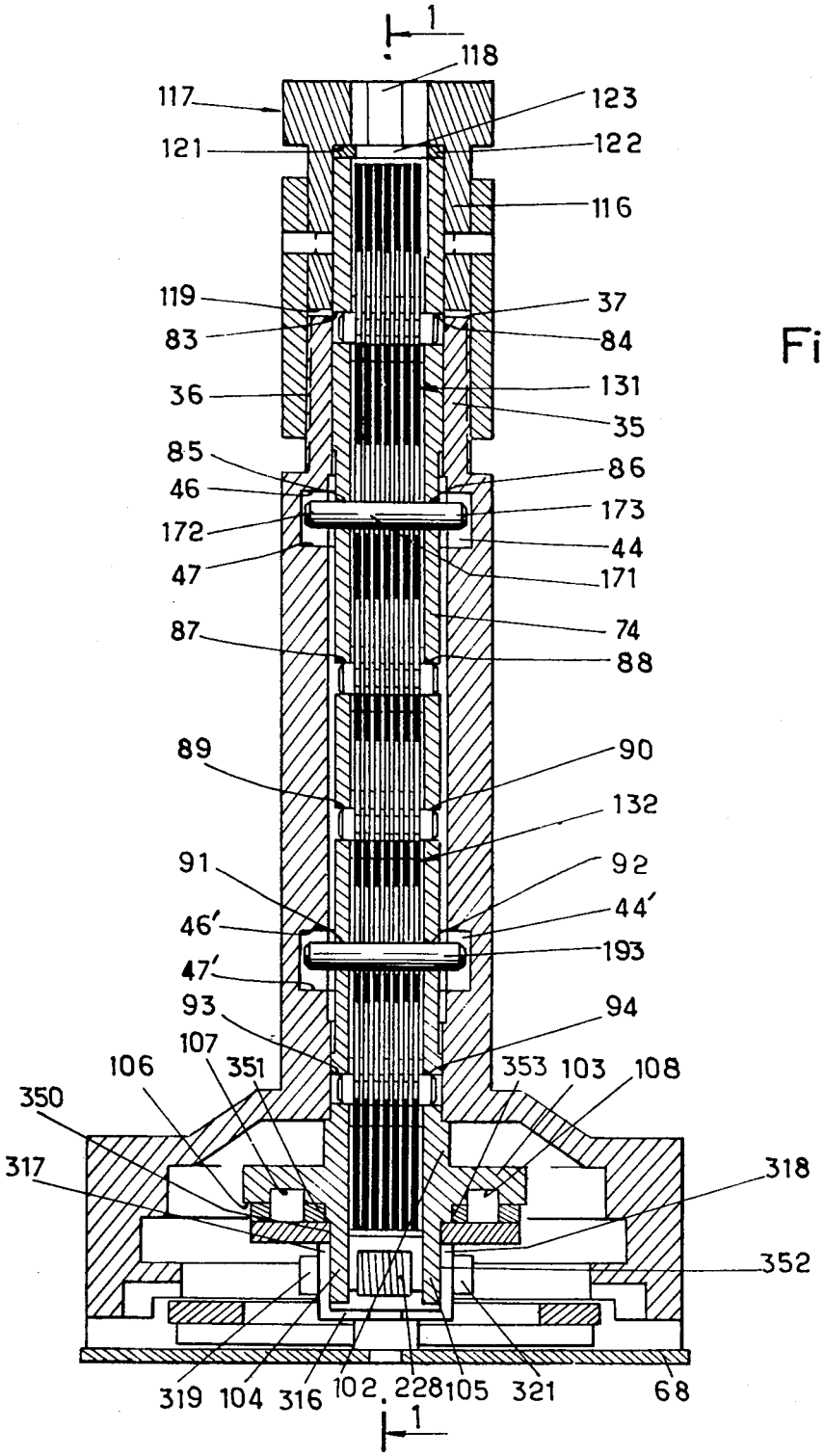
FIG. 2 is a longitudinal cross-sectional view taken along line 2—2 in FIG. 1.

In the position shown in FIGS. 1 and 2 the lock is not actuated. Here under the effect of the body 221 of the pivoted member 222 which is itself subjected to the force exerted by the arm 227 of the torsion spring 228, the bars of the second set 132 are thrust forward. Each of the bars pushes by its edge 177 the facing edge of the corresponding bar 133. The forward edges of the bar 133 are thus immediately behind the keyhole disc 122. Also in this position the peg 297 is in engagement with the notch 295 in the ring member 282 under the action of torsion spring 305. The roller 267 carried by the check fence plate 257 is situated facing generatric 61 at the maximum distance from the axis 54, springs 251 and 252 urge protrusions 247 and 248 of the fence plate 233 so that the latter are in contact with the edges 255 and 256 of the check fence plate. The apex 239 of the fence plate 233 faces the relief portion 62 with a rounded apex 65 on the lock case.

In order to open the lock, the right key is inserted into the keyhole 118 and keyhole 123, the inner end of the key stem 145 bearing, upon complete insertion, against the forward face of the disc 122. The bars 133 of the first set are displaced lengthwise corresponding to the cuts in the key and their movement is transmitted by the abutment of their round edges 175 against the rounded edges 177 of bars 176, which movement is effected against the action of the sector members 202 retained by the leaf springs 211, the bar 176 farthest from the keyhole 123 displacing the pivoted member 222 against the bias of spring 288. Due to the meshing of the racklike teeth 189 on the bars 176 with the toothed sector 201, the latter are angularly displaced precisely the amount so that their notches are aligned facing the fence plate, that is, the edges 207 of all the notches 206 are coplanar and the edges 208 of the notches 206 are also coplanar. The edges 207 are then in the continuation with the front face of the fence plate and the edges 208 are in the continuation of the back face of the fence plate. The bars 133 are guided in displacement by the co-operation of the edges of the slots 151 and 161 with the cross-pieces 162 and 164 and the bars 176 are guided by co-operation of the edges of the slots 179 and 181 with the cross-pieces 191 and 192.

After insertion of the right key, the key may be turned. The barrel is driven by the co-operation of the parallelepipedic body 363 on the key with the sides 359 and 360 of the keyhole 123 in the disc 122 fixed to the barrel. The faces 350 and 351 of the parallelepipedic body of the barrel thus rotate the check fence plate 357 as well as the fence plate 233. Owing to this rotational movement, the roller 267 of the check fence plate co-operates with the inclined zone 58 as it gradually moves away from generatrix 61, which imparts a movement to the check fence plate tending to bring the roller 267 closer to the axis 54. During this movement the edges 269 and 271 of the check fence plate slide against faces 351 and 353 of the parallelepipedic body 103 of the barrel. The linear movement of the check fence plate is transmitted to the fence plate through springs 251 and 252. By the edge 231 of window 232 in fence plate 233 moving closer to the axis 54, the fence plate is engaged with the aligned notches 206 until its edge 231 contacts the inner ends 209 of the notches 206. Once this movement is completed, the pin 245 carried by the fence plate is engaged in the wide notch 289 of the ring member 282 and when the movement is continued, the pin 245 is adapted to co-operate with the flank 292 for rotating the ring member.

Previously the pin 245 co-operated with the lever 298 to cause it to pivot when pivot pin 301 rotates in recess 301' so as to disengage the peg 297 from the notch 295. The ring member 282 is thus unlatched, the further turning movement of the key causes the ring member 282 to rotate about axis 54 which is turn rotates the pinion or gear 284 to which it is fixed. The pinion or gear in turn withdraws the bolt or bolts.

The lock is returned to its closed position again by turning the key in the opposite direction. The ring member 282 is rotated in the direction opposite that for opening the lock and therefore by means of the external teeth 285 on the pinion or gear 284 the bolt or bolts are returned to their closed position. As the bolt or bolts are once again in their extended position the further movement of the key disengages the pin 245 from notch 289; the fence plate and the check fence plate simultaneously undergo rotational movement relative to the lock case and translatory movement with respect to the parallelepipedic body of the barrel, controlled by the co-operation of the roller on the check fence plate with the inclined zone 58 and by the action of the flank 64 of the relief portion 63 with the apex 239 of the fence plate 233. Finally, the lock is once again in its locked position. The bars are back in their initial position under the action of the pivoted member 222 which urges then forwardly.

If one attempts to open the lock with a key whose cuts does not correspond to the lock, the insertion of the key duly causes displacement of the bars 133 and 176 but the sector members 202 are not rotated to their positions in which the notches are aligned facing the fence plate. If, however, the barrel is turned, by forcing the key, the check fence plate is rotated but its sliding movement is not followed by the fence plate which abuts against the edge 231 of the window 232 against the edges 205 of the sector members 202. If, however, one continues to force the lock by turning the key, the movement of the barrel continues as well as the movements of the fence plate and check fence plate. Yet the pin 245 of the fence plate is held spaced from the lever 298 so that the peg thereon stays in engagement with the notch 295, locking the ring member 282 and there by also the pinion or gear 284. In this position of the lock the pin 245 rotates inside the opening 281 in the ring member without contacting face 288 thereon whereby the pathway of the pin 245 does not enter the notch 289 so that during rotational movement of the fence plate the pin 245 does not come into co-operation with flank 292 and the ring member 282 is not rotated. The lock is, so to speak, disengaged and the bolt or bolts remain in their locked position. The rotation of the key in the lock continues thereby avoiding breaking of parts without, however, having an effect on the opening of the bolt or bolts.

If in an attempted unauthorized opening of the lock, where one tries to discover the positions of the bars necessary to bring the corresponding notches in the requisite position, it is impossible to ascertain any information during the movement of one of the bars of the first set which tend to move toward the forward face because in the course of such movement the bars of the first set do not drive the bars of the second set which are their continuation.

An attempt at boring through the center of the lock is efficaciously thwarted by the cross-pieces 171 and 193 whose ends project relative to the barrel and an attempt to bore along the spindle 204 is precluded by bar 356.

The nature of the metal of which the nose piece is made, hardness treated, is a factor which strengthens the lock without substantially increasing its production cost because the nose piece is independent from the body of the lock, it is of small size and it is easy to treat.

Figure 21:
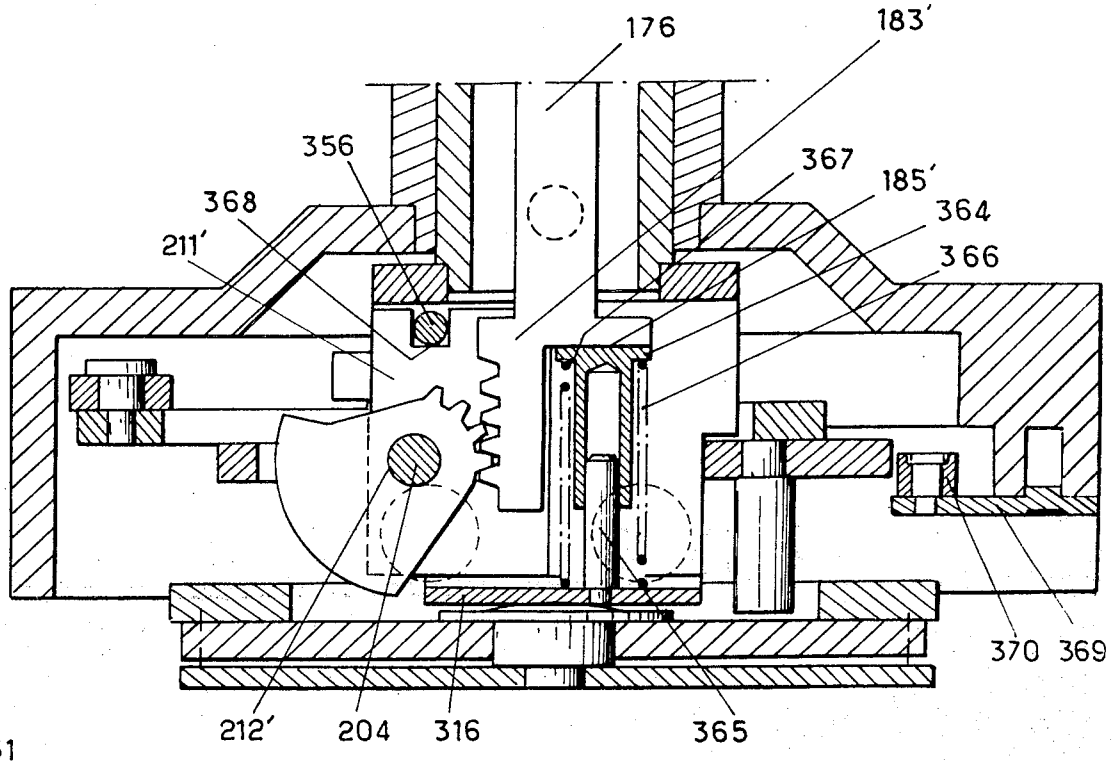
FIG. 21 is a fragmentary longitudinal cross-sectional view of a modified embodiment of the lock.

In another embodiment of the lock (FIG. 21), the pivoted member 222 is replaced by a plunger 364 slidably mounted along the axis 54 on a pin 365 and subjected to the biasing force of spring 366 which bears against part 316 and against a flange 367 on the plunger 364. The forward part of the plunger 364 acts through shoulders 185' provided on the enlarged portions 183' of the bars 176. The leaf springs 211 are replaced by leaf springs 211' differing only by their outer contour which is generally rectangular and having in addition a hole 212' similar to hole 212 in leaf springs 211 for receiving spindle 204, a notch 368 receiving bar 356 which holds leaf spring 311' in a direction perpendicular to bar 356. The bar 355 can then be eliminated.

In this modified embodiment the relief portion 62 is formed as a part 369 mounted on the cup-shaped body 32 and on the portion closest to the axis 54 of part 369 is swivelly mounted a roller 370 the outer surface of which acts as the relief portion 62.

Otherwise the parts of this embodiment are like those described above.

In another embodiment the fence plate and the check fence plate are fixed to each other; the springs 251 and 252 are then replaced by rigid members. In the modified embodiment the lock no longer has the disengageable capability described above.

Two kings of locks may thus be obtained without any important alterations.

There may also be provided in addition to the two sets of bars one or more sets of intermediate bars which enables the lock to be adapted to the thickness of the door on which it is to be fitted.

What is claimed is:

1. A Bramah lock for a door of a safe-deposit box or an armored door, comprising a locking and unlocking mechanism actuatable by motion transmitting members formed as bars disposed in at least two serially arranged sets extending through the door to a keyhole and co-operable by abutment from the keyhole to the locking and unlocking mechanism so that displacements towards the keyhole of motion transmitting members relatively adjacent to the keyhole are not transmitted to motion transmitting members relatively remote therefrom.

2. The lock according to claim 1, further comprising crosspieces mounted in a barrel for guiding said bars of one of said sets.

3. The lock according to claim 2, wherein said crosspieces have notches for accommodating each of said bars of said one of said sets.

4. The lock according to claim 1, wherein transverse blocks extend through said bars and their ends protrude relative to said barrel.

5. The lock according to claim 4, wherein said ends of said transverse block are received in grooves in a lock case.

6. The lock according to claim 5, wherein said grooves in said lock case are larger than the blocks.

7. The lock according to claim 5, further comprising means for adjusting the length of said lock case.

8. The lock according to claim 7, wherein said means for adjusting the length of said lock case comprises an intermediate sleeve connected to the lock case and a frontal nose piece.

9. The lock according to claim 1, further comprising a spring-biased pivoted member urging at least one said bar to its extended position.

10. A Bramah lock for a door of a safe-deposit box or an armored door, comprising a locking and unlocking mechanism actuatable by motion transmitting members formed as bars extending through the door to a keyhole, said motion transmitting members being arranged in series and co-operable by abutment from the keyhole to the locking and unlocking mechanism so that displacements towards the keyhole of motion transmitting members relatively adjacent to the keyhole are not transmitted to motion transmitting members relatively remote therefrom, a barrel, a plurality of coaxial toothed sector members driven individually by said motion transmitting members, the outer peripheral edges of said sector members having slots for engagement with a fence member when said slots are in alignment, wherein said fence member is driven by a check fence member resiliently connected thereto and displaceable in response to the movement of the barrel so as to permit rotation of the barrel even if said fence member is not in engagement with said slots of said sector members.

11. The lock according to claim 10, wherein said fence member and said check fence member are plates slidably mounted on each other.

12. The lock according to claim 11, wherein resilient means are interposed between said fence plate and said check fence plate.

13. The lock according to claim 12, wherein said resilient means comprise a pair of springs.

14. The lock according to claim 11, wherein rigid means are interposed between said fence plate and said check fence plate.

15. The lock according to claim 10, wherein said fence plate and said check fence plate are displaceable in a direction perpendicular to the axis of the lock.

16. Bramah lock for a door, comprising a housing into which is managed a keyhole for the introduction of a key, a locking and unlocking mechanism, a number of a transmitting members slidably lodged into said housing and extending between said keyhole and said mechanism in order for the key to actuate said mechanism, each transmitting member being composed of at least two aligned bars, a first bar having a forward end capable of being actuated by said key and an inward end capable of pushing inwardly a second bar by abutment onto the outward end of said second bar, a single resilient element common to all members being provided to urge said members towards said keyhole.

17. Bramah lock according to claim 16, said single element being a plate actuated by a spring.

18. A lock according to claim 16, wherein the innermost bars act on a plurality of tumblers, said tumblers being friction mounted in order for them to remain motionless when said members do not act on them.

19. A Bramah lock comprising a barrel mounted for rotation into a housing and freely movable into said housing, said barrel carrying: a series of tumblers each having a notch, a fence member movable from a first position into a second position into which it is engaged into said aligned notches to check whether the opening combination have been set and carrying an actuating finger, an actuating plate being displaceable by cooperation of one of its portions with a corresponding cammed portion of the housing, a resilient means being interposed between said fence and said actuating plate, said actuating finger driving through the rotation of said barrel an actuating bolt ring whenever said fence is in its second position, and said finger being freely rotatable when said fence is in its first position.

20. Bramah lock for a door, comprising a housing into which is managed a keyhole for the introduction of a key, a locking and unlocking mechanism, a number of transmitting members slidably lodged into said housing and extending between said keyhole and said mechanism in order for the key to actuate said mechanism, each transmitting member being composed of at least two aligned bars, a first bar having a forward end capable of being actuated by said key and an inward end capable of pushing inwardly a second bar by abutment onto the outward end of said second bar.

21. A lock according to claim 19, said ring being externally toothed and coaxial of said barrel.

* * * * *

UNITED STATES PATENT AND TRADEMARK OFFICE

CERTIFICATE OF CORRECTION

PATENT NO. : 4,187,705
DATED : February 12, 1980
INVENTOR(S) : Francois Guiraud

It is certified that error appears in the above—identified patent and that said Letters Patent is hereby corrected as shown below:

Figure 1 change "356" (adjacent numerals 53 and 211) to --356'--.

Column 3, line 38, change "356" to --356'--;
Column 4, line 43, change "171" to --172--;
Column 5, line 60, change "streight" to --straight--;
Column 6, line 44, change "356" to --356'--;
Column 7, line 27, change "357" to --257--;
Column 9, line 10, change "kings" to --kinds--.

Column 10, line 19, change "into" to --in--; line 22, change "into" to --in--; line 39, change "into" to --in-- (both occurances) line 53, change "into" to --in--; line 56, change "into" to --in--.

Signed and Sealed this

Eleventh Day of November 1980

[SEAL]

Attest:

SIDNEY A. DIAMOND

Attesting Officer

Commissioner of Patents and Trademarks